US007960635B2

(12) United States Patent
Rice

(10) Patent No.: US 7,960,635 B2
(45) Date of Patent: Jun. 14, 2011

(54) COMBINATION DRUMSTICK

(76) Inventor: James A Rice, Tampa, FL (US)

( * ) Notice: Subject to any disclaimer, the term of this patent is extended or adjusted under 35 U.S.C. 154(b) by 64 days.

(21) Appl. No.: 12/206,795

(22) Filed: Sep. 9, 2008

(65) Prior Publication Data

US 2010/0058919 A1 Mar. 11, 2010

(51) Int. Cl.
*G10D 13/02* (2006.01)

(52) U.S. Cl. ..... 84/422.4; 446/418

(58) Field of Classification Search ..... 84/422.4; 446/418–420, 422; D17/22, 23
See application file for complete search history.

(56) References Cited

U.S. PATENT DOCUMENTS

| | | | | |
|---|---|---|---|---|
| 2,466,554 | A | 4/1949 | Mossey | |
| D206,134 | S * | 11/1966 | Gussak | D17/22 |
| D211,964 | S | 8/1968 | Valente | |
| D220,002 | S | 2/1971 | Barker | |
| 3,592,097 | A | 7/1971 | Friede | |
| 3,722,350 | A | 3/1973 | Cordes | |
| 4,040,323 | A | 8/1977 | Kline | |
| 4,269,105 | A | 5/1981 | Salmon | |
| 5,265,514 | A | 11/1993 | Schertz | |
| D386,779 | S | 11/1997 | Burgos | |
| 6,316,709 | B1 | 11/2001 | Nanberg | |
| D473,259 | S | 4/2003 | Izen | |
| 2008/0184867 | A1 * | 8/2008 | Davis et al. | 84/422.4 |

* cited by examiner

*Primary Examiner* — Jianchun Qin
(74) *Attorney, Agent, or Firm* — Michele L. Lawson; Smith & Hopen, P.A.

(57) ABSTRACT

Combination drumstick for producing a tambourine sound from a plurality of jingle pairs loosely mounted within discrete apertures dispose along and through the combination drumstick. The weight of the combination drumstick is centered in the axis of the combination drumstick for balance and the stick portion is formed from a polymeric material for durability to permit one-handed combination drumming and tambourine sound production.

19 Claims, 3 Drawing Sheets

COMBINATION DRUMSTICK

FIELD OF THE INVENTION

The present invention relates generally to musical instruments. More particularly, the present invention relates to percussive instruments such as drumsticks and tambourines, in combination.

BACKGROUND

Percussion instruments produce sound through the impact of one part against another, and such instruments have been known since antiquity. The clashing sound when thin sheets of brass are struck is familiar from the tambourine and cymbal, and modern drum kits incorporate cymbals and diverse types of drums so that the drummer can support the music with a range of percussive sounds.

Attempts have been made to combine percussive instruments to extend the range of effects that a single percussionist can achieve. For example, U.S. Pat. No. 4,269,105 discloses a wooden instrument producing the striking tone of a clave, the sound of a tambourine, and the grating sound of a guiro.

Where a drumstick is combined with another instrument, particular problems arise. A skilled drummer can produce complex, rapid rhythms from the array of drums and snares in his kit. To perform well, a drumstick must be lightweight, balanced in its weight distribution, and durable. In addition, it must have a combination of hardness and elastic modulus that contribute to producing the precise sound quality a drummer seeks. This has been typically achieved by selecting the type of wood from which the drumstick is made. Without proper balance and weight, fluid bounce and consistent impact of the drum are lost. The design of the striking tip is also important for proper bounce-back and to avoid damage to drum heads and cymbals. Each of these qualities may be compromised when it is attempted to incorporate a second instrument into a drumstick.

Attempts have been made to combine a tambourine like instrument with a drumstick by attaching jingles to the exterior of the drumstick, either as a single cymbal pair (U.S. Pat. No. 3,592,097) or as an array of cymbals (U.S. Pat. No. 6,316,709). These devices suffer from the drawback that the mass of the jingle apparatus displaces the center of gravity of the instrument so that it no longer lies in the axis of the drumstick, and so the instrument is unbalanced. The effect is lessened in an instrument comprising only one pair of jingles, but the volume of sound that can be produced is significantly reduced. Such designs have not achieved significant marketplace acceptance.

It is also known to mount jingles within a sturdy wooden stick to produce a jingle stick, e.g. U.S. Pat. Nos. 4,269,105; D473,259S; D211,964; and D386,779. However, each of these designs suffers from the drawback that the weight and bulkiness of the construction required to achieve durability renders them unsuitable for use as drumsticks.

The ability of a drummer to produce a tambourine-like sound in precise synchronization with his drumming is valuable and one-handed operation frees the other hand for other tasks. However, to gain acceptance, such a design must be lightweight, balanced, durable, and have a combination of hardness and elastic modulus that provides the sound quality a drummer seeks.

For the foregoing reasons, there is a need for a combination drumstick that combines the low weight, durability, elastic modulus, and hardness of a quality drumstick with the ability to produce a tambourine-like sound. That the present inventions satisfies these needs and more will become apparent to one of ordinary skill upon reading the disclosure, figures, and claims appended hereto.

SUMMARY

The present invention is directed to a combination drumstick for producing a tambourine sound that satisfies these needs. A combination drumstick having features of the present invention comprises an elongate member formed of a polymeric material. This elongate member comprises a tapered drum engaging end at a first extremity, the drum engaging end comprising a terminal enlarged tip for striking a drum. The member further comprises a hand engaging end at a second extremity for holding by a user. A plurality of apertures extend through the member and are disposed between the first extremity and the second extremity. The apertures are disposed in a coplanar relation in one plane defined by the elongate member. Within each aperture, a pair of disk-like jingles are loosely mounted, so that the combination drumstick emits a tambourine-like sound when the drum engaging end strikes a drum or the combination drumstick is otherwise shaken.

In certain preferred embodiments, the number of apertures and jingle pairs is from two to six.

In certain other embodiments, the elongate polymeric member is formed from a thermoplastic material for ease of manufacture.

In other embodiments, the polymeric material is selected to yield a combination drumstick having properties resembling those of prior art wooden drumsticks, wherein the elongate polymeric member has a weight of between about 1.5 ounces to about 3.0 ounces, and the polymer density is adjusted by the addition of foaming agent, or hardened by the addition of a hardener, or dyed by the addition of a pigment.

In another embodiment, a combination drumstick having features of the present invention has a substantially cylindrical polymeric member with, in sequence, a hand engaging end, a plurality of coplanar apertures extending through said member, a tapered drum engaging end, the drum engaging end comprising a terminal enlarged tip. Within each aperture a pair of jingles is loosely mounted so that the combination drumstick emits a tambourine-like sound when the drum engaging end engages a drum or is otherwise shaken.

In certain preferred embodiments, the jingles are mounted within aperture by a pin that spans the aperture and is mounted to the member at each end.

It is therefore a first object of the present invention to provide a combination drumstick that is capable of practical use in the manner of a conventional drumstick, but which also can be made to emit the sound of a tambourine when struck on a drum or independently shaken.

It is a further object of the present invention to provide a combination drumstick that has sufficient strength and durability to withstand vigorous and sustained drumming use without breakage notwithstanding the apertures therein.

It is yet a further object of the present invention to provide a combination drumstick that permits a drummer to make drum and tambourine sounds in precise synchronization.

It is also an object of the present invention to provide a combination drumstick that is of conventional weight and is properly balanced for control, for rapid playing, and for providing comfortable use for extended periods of playing.

It is also an object of the present invention to provide a combination drumstick that impacts a drum and produces a drum sound that is comparable to the impact and sound produced by a prior art wooden drumstick lacking jingles.

BRIEF DESCRIPTION OF THE DRAWINGS

These and other features, aspects, and advantages of the present invention will become better understood with regard to the following description, appended claims, and accompanying drawings where:

DESCRIPTION

An exemplary and non-limiting embodiment of the present invention will now be described with reference to the attached figures.

Figure 1:
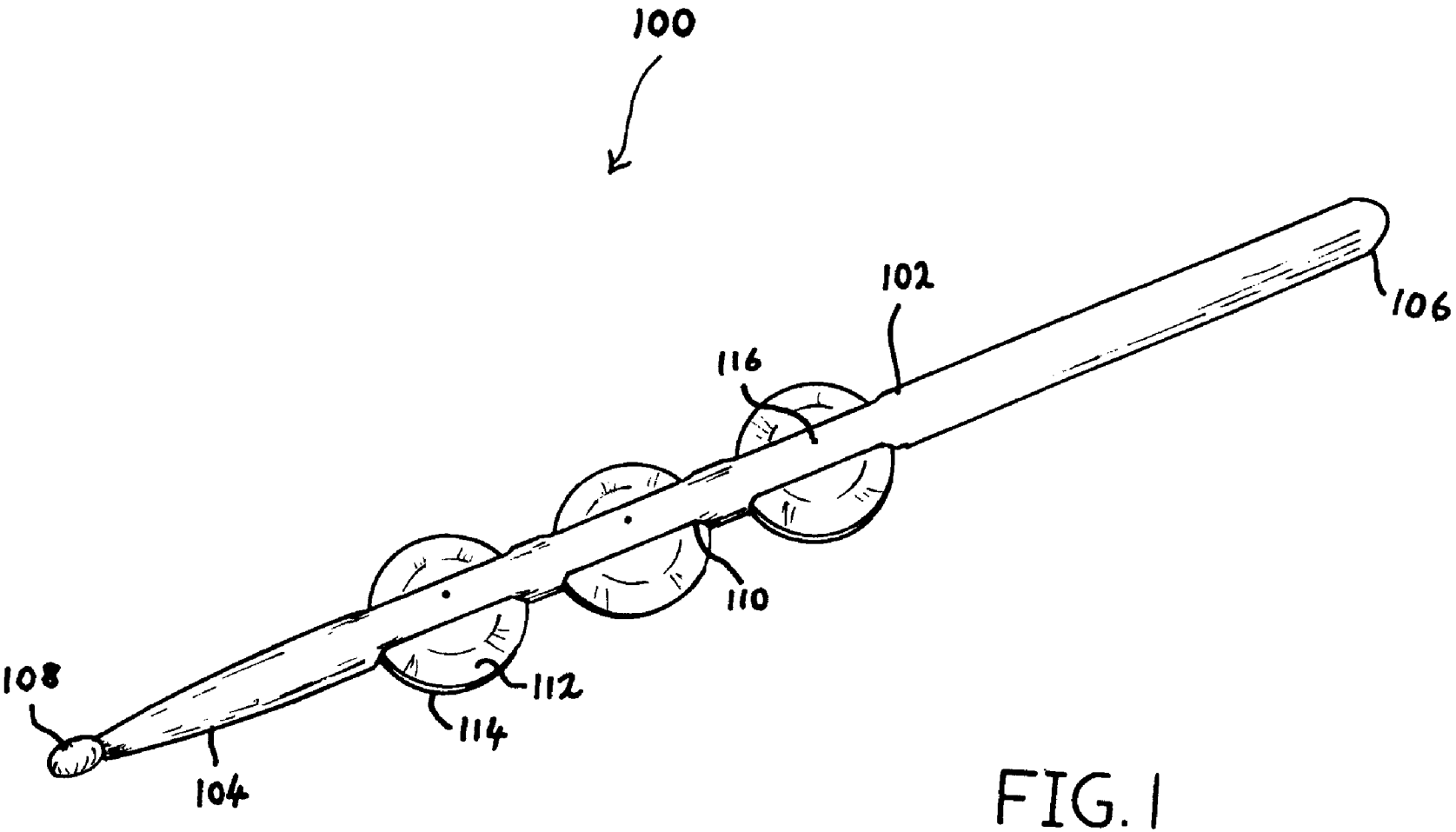
FIG. 1 shows a perspective view of one embodiment of a combination drumstick according to the present invention.

Referring now to FIG. 1, a combination drumstick 100 comprises elongate polymeric member 102 having, at a first extremity, a tapered drum engaging end 104 and, at the second extremity, a hand engaging end 106. The tapered drum engaging end 104 comprises terminal enlarged tip 108 for engaging a drum. Between the first and second extremities, a plurality of apertures 110 extend through member 102 and are disposed in a coplanar arrangement about one plane defined by the longitudinal axis of elongate member 102. Within each aperture 110, a pair of jingles 112, 114 are loosely mounted by pin 116 for making a tambourine-like sound when the drum engaging end 104 strikes a drum or when the combination drumstick is otherwise shaken or jarred.

The shape of elongate polymeric member 102 can be similar to that of a prior art wooden drumstick, but can also be any elongate shape suitably adapted for drumming and which comprises a drum engaging end, a hand engaging end, and apertures with mounted jingles therebetween. In some embodiments, the member can comprise one or more bends, and/or can vary substantially in its cross-sectional shape and/or area along its length.

Member 102 is formed from a polymeric material for ease of manufacture. Suitable polymers include, but are not limited to, polypropylene, polyurethane, polyamide, polyphthalamide, polyolefin, polycarbonate, or a mixture thereof. In preferred embodiments, the polymer comprises fibers such as glass fibers, carbon fibers, or the like, for additional strength and durability, and also to adjust the playing characteristics of the combination drumstick such as, for example, the impact and sound produced by the combination drumstick, which are know to be important characteristics of a drumstick by those of ordinary skill in the art, and which are influenced by mechanical properties of the drumstick such as rigidity as measured by the modulus of elasticity, density, hardness, and overall weight. Specific examples of suitable fiber filled polymers include, but are not limited to, PP-40G and PP-50G polypropylene homopolymer, 40%-60% long glass fiber filled or carbon fiber filled thermoplastic polyurethanes, 30%-50% glass fiber or carbon fiber filled polyamides such as Nylon 6 or Nylon 6,6, or about 40% glass fiber filled polycarbonate. The density of the polymer can be decreased by the optional inclusion of 1% to 2% of a foaming agent such as Endex 2750 or the like. The hardness of the polymer can be increased by adding a few percent of a hardening agent such as spherical filler Alterin 110 or the like. The color of member 110 can be changed by adding a pigment such as carbon black or a dye.

In preferred embodiments, the weight of member 110 is selected to approximate that of prior art wooden drumsticks, for example within the range of between about 1.5 ounces to about 3.0 ounces, to approximate the weights of typical prior art drumsticks of hickory, oak, maple, birch, beech, ebony and rosewood.

Tapered drum engaging end 104 can be a long or short taper extending over several inches or over a few tenths of an inch, or any length between, according to preference. For example, a combination drumstick of largest diameter 0.63 inches can comprise a 3 inch taper to a final diameter of about 0.25 inches.

Hand engaging end 106 can comprise a textured surface, be shaped to conform to the hand of a user, or otherwise be adapted to facilitate gripping while drumming.

Terminal enlarged tip 108 can be of any shape known in the drumming art or that permits drumming including, without limitation, a pear-shaped tip, a conical tip, an oval tip, or a spherical tip.

Preferably, between 2 and 5 apertures 110 are provided, and most preferably three apertures 110 are provided. The size of the aperture 100 is selected to loosely accommodate jingles 112, 114 without compromising the durability of the combination drumstick. Exemplary apertures for a combination drumstick of about 0.6 inches diameter at its widest point include apertures of about 0.3 inches width, and about 1.6 inches in length. Preferably, the apertures are separated by about 0.5 to 1.0 inches for durability. The apertures 110 are essentially coplanar to permit the mounting of jingles 112, 114 in a coplanar arrangement, and can be formed, for example, by injection molding. It is not a requirement of the present invention that all apertures have the same dimensions.

Jingle pairs 112, 114 are loosely mounted by a secure means within each aperture 110. A pin 116 extending from one surface of the aperture to an opposite surface of the aperture can be used to secure the jingles 112, 114, but other means such as screws or bolts can also be used. The jingles 112, 114 can be of any shape and material capable of mounting to the aperture and producing a desired sound when shaken or jarred. The jingles 112, 114 are preferably formed of a sheet metal such as brass or steel, preferably nickel-plated steel, and can optionally comprise concentric corrugations as is well known in the tambourine arts. Preferably, the jingles 112, 114 are mounted about the axis of the member 110 for optimum balance.

Figure 2:
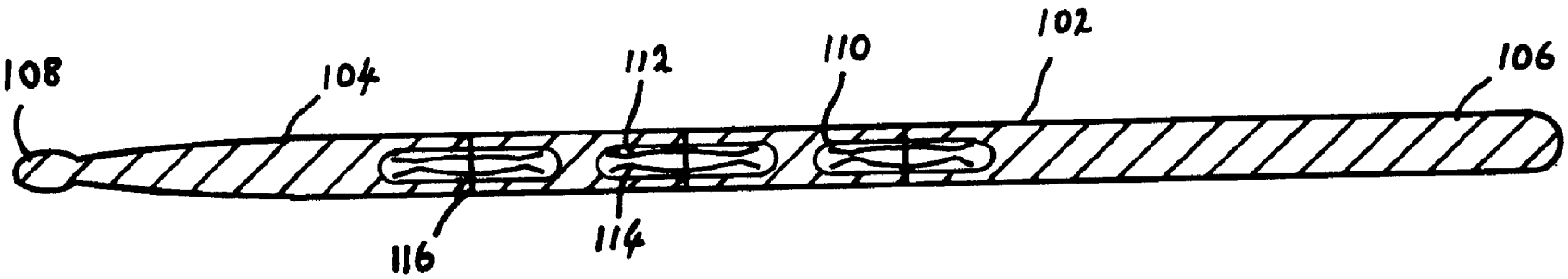
FIG. 2 shows a vertical section of the combination drumstick of FIG. 1.
Figure 3:
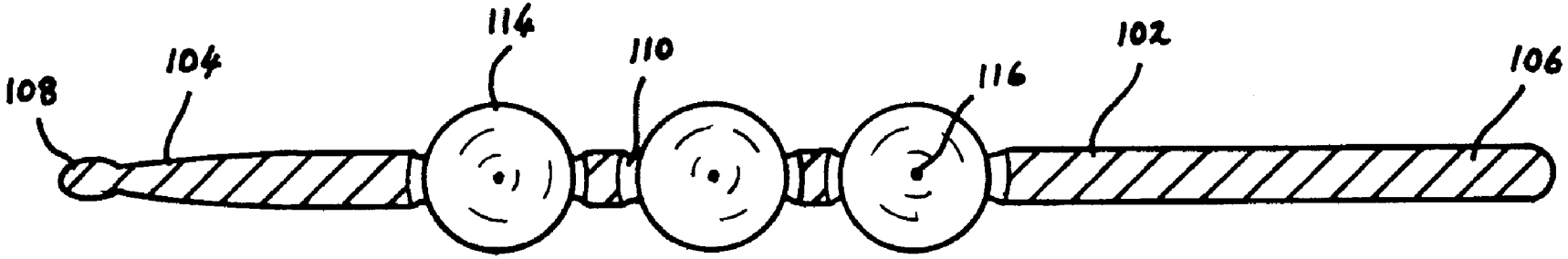
FIG. 3 shows a horizontal section of the combination drumstick of FIG. 1.

Referring now to FIG. 2, there is shown a vertical section of the combination drumstick of FIG. 1 in which like elements are numbered similarly.

Referring now to FIG. 2, there is shown a horizontal section of the combination drumstick of FIG. 1 in which like elements are numbered similarly.

In use, the present invention permits a drummer to produce a tambourine effect within the user's drumming using only one hand. The tambourine effect can be subtly modified according to the manner and orientation in which the combination drumstick is held. For example, different timbre can be produced by varying the rotation of the combination drumstick in the hand.

The previously described versions of the present invention have many advantages, including balance, light weight, durability, and superior musical qualities including impact and sound. By mounting the jingles within the combination drumstick, rather than attaching them to the exterior of the stick, improved balance is obtained because the mass of the jingles is disposed about and along the axis of the combination drumstick. The use of polymeric materials provide essential durability and strength that the inventor has found could not be obtained using woods. The optional components of the polymeric member, such as foaming agents, hardening agents, and fibers, permit the tailoring of physical properties such as elastic modulus, hardness, and density within the range of prior art wood materials, whereby superior musical qualities including improved impact and sound can be obtained. However, it is not necessary that all of the advantageous features and all of the advantages be incorporated into every embodiment of a combination drumstick according to the present invention.

Although the present invention has been described in considerable detail with reference to certain preferred versions thereof, other versions are possible and can be envisaged within the scope and spirit of the present invention. Therefore, the spirit and scope of the appended claims should not be limited to the description of the preferred versions contained herein.

What is claimed is:

1. A combination drumstick for producing a tambourine sound, the combination drumstick comprising:

an elongate solid polymeric member comprising a tapered drum engaging end at a first extremity and a hand engaging end at a second extremity, the drum engaging end comprising a terminal enlarged, substantially rounded, ball-like, solid tip;

a plurality of apertures extending through said member and disposed between the first extremity and the second extremity, the apertures disposed in coplanar relation in one plane defined by the elongate member wherein said apertures are separated from each other by between about 0.5 inches and about 1 inch; and a pair of disk like jingles loosely mounted within each said aperture; so that the combination drumstick emits a tambourine sound when the drum engaging end engages a drum.

2. The combination drumstick according to claim 1, in which the plurality of apertures is from two to six apertures.

3. The combination drumstick according to claim 2, in which the plurality of apertures is three apertures.

4. The combination drumstick according to claim 1, in which the elongate polymeric member is a thermoplastic member.

5. The combination drumstick according to claim 4, in which the thermoplastic member is selected from the group consisting of a fiber filled polypropylene, a fiber filled polyurethane, a fiber filled polyamide, a fiber filled polyphthalamide, a fiber filled polyolefin, a fiber filled polycarbonate, and mixtures thereof.

6. The combination drumstick according to claim 4, in which the thermoplastic member further comprises a foaming agent.

7. The combination drumstick according to claim 4, in which the thermoplastic member further comprises a hardening agent.

8. The combination drumstick according to claim 1, in which the elongate polymeric member has a weight of between about 1.5 ounces to about 3.0 ounces.

9. The combination drumstick according to claim 1, in which the elongate polymeric member further comprises a pigment.

10. A combination drumstick for producing a tambourine sound, the combination drumstick comprising:

a substantially cylindrical solid polymeric member comprising, in sequence, a hand engaging end, a plurality of coplanar apertures extending through said member wherein said apertures are separated from each other by between about 0.5 inches and about 1 inch, a tapered drum engaging end, the drum engaging end comprising a terminal enlarged, substantially rounded, ball-like solid tip; and a pair of jingles loosely mounted within each said aperture; so that the combination drumstick emits a tambourine sound when the drum engaging end engages a drum.

11. The combination drumstick according to claim 10, in which the jingles are mounted to said aperture by a pin spanning said aperture and mounted to said member at each end.

12. The combination drumstick according to claim 10, in which the plurality of apertures is from two to six apertures.

13. The combination drumstick according to claim 12, in which the plurality of apertures is three apertures.

14. The combination drumstick according to claim 10, in which the polymeric member is a thermoplastic member.

15. The combination drumstick according to claim 14, in which the thermoplastic member is selected from the group consisting of a fiber filled polypropylene, a fiber filled polyurethane, a fiber filled polyamide, a fiber filled polyphthalamide, a fiber filled polyolefin, a fiber filled polycarbonate, and mixtures thereof.

16. The combination drumstick according to claim 14, in which the thermoplastic member further comprises a foaming agent.

17. The combination drumstick according to claim 14, in which the thermoplastic member further comprises a hardening agent.

18. The combination drumstick according to claim 10, in which the elongate polymeric member has a weight of between about 1.5 ounces to about 3.0 ounces.

19. The combination drumstick according to claim 10, in which the elongate polymeric member further comprises a pigment.

* * * * *